US006107733A

United States Patent [19]

Jager

[11] Patent Number: 6,107,733

[45] Date of Patent: Aug. 22, 2000

[54] ANODE FOR A FLAT DISPLAY SCREEN

[75] Inventor: Axel Jager, Sussargues, France

[73] Assignee: Pixtech S.A., Rousset, France

[21] Appl. No.: 09/069,465

[22] Filed: Apr. 29, 1998

[30] Foreign Application Priority Data

Apr. 30, 1997 [FR] France ..... 97 05601

[51] Int. Cl.[7] ..... H01J 1/62; H01J 63/04

[52] U.S. Cl. ..... 313/496; 313/495; 313/497

[58] Field of Search ..... 313/495, 496, 313/491, 492, 494, 309, 336, 351, 497

[56] References Cited

U.S. PATENT DOCUMENTS

| | | | |
|---|---|---|---|
| 5,508,584 | 4/1996 | Tsai et al. | 313/497 |
| 5,541,478 | 7/1996 | Troxell et al. | 313/497 |
| 5,773,927 | 6/1998 | Zimlich | 313/495 |

FOREIGN PATENT DOCUMENTS

| | | |
|---|---|---|
| 0527240 | 2/1993 | European Pat. Off. . |
| 9708731 | 3/1997 | WIPO . |

OTHER PUBLICATIONS

Patent Abstract of Japan, vol. 010, No. 263 (E–435), Sep. 9, 1986 & JP 61 088432 A.

Copy of French Search Report for 97/05601, dated Jan. 15, 1998.

*Primary Examiner*—Nimeshkumar D. Patel
*Assistant Examiner*—Michael J. Smith
*Attorney, Agent, or Firm*—Arthur L. Plevy; Buchanan Ingersoll PC

[57] ABSTRACT

The present invention relates to a flat display screen anode of the type including at least two sets of parallel alternate strips of anode conductors coated with phosphor elements and separated from one another by insulating strips, and focusing conductive strips, aligned and substantially centered with the insulating strips, the focusing conductive strips having lower widths than the insulating strips.

11 Claims, 2 Drawing Sheets

ANODE FOR A FLAT DISPLAY SCREEN

BACKGROUND OF THE INVENTION

1. Field of the Invention

The present invention relates to flat display screens, and more specifically to so-called cathodoluminescence screens, the anode of which supports phosphor elements separated from one another by insulating areas, and likely to be energized by electron bombardment. This electron bombardment requires the biasing of the phosphor elements and can come from microtips, from layers of low extraction potential, or from a thermo-ionic source.

To simplify the present description, only color microtip screens will be considered hereafter, but it should be noted that the present invention relates, generally, to the various above-mentioned types of screens and the like.

2. Discussion of the Related Art

FIG. 1 shows the structure of a conventional flat color microtip screen.

Such a microtip screen is essentially formed of a cathode 1 with microtips 2 and of a grid 3 provided with holes 4 corresponding to the locations of microtips 2. Cathode 1 is placed facing a cathodoluminescent anode 5, a glass substrate 6 of which forms the screen surface.

The operating principle and a specific example of embodiment of a microtip screen are described, in particular, in U.S. Pat. No. 4,940,916 of the Commissariat à l'Energie Atomique.

Cathode 1 is generally organized in columns and is formed, on a glass substrate 10, of cathode conductors organized in meshes from a conductive layer. Microtips 2 are made on a resistive layer 11 deposited on the cathode conductors and are arranged within the meshes defined by the cathode conductors. FIG. 1 partially shows the inside of a mesh and the cathode conductors do not appear on the drawing. Cathode 1 is associated with grid 3 organized in lines. The intersection of a line of grid 3 and of a column of cathode 1 defines a pixel.

This device uses the electric field created between cathode 1 and grid 3 to extract electrons from microtips 2. These electrons are then attracted by phosphor elements 7 of anode 5 if these elements are properly biased. In the case of a color screen, anode 5 is provided with alternate strips of phosphor elements 7*r*, 7*g*, 7*b*, each corresponding to a color (Red, Green, Blue). The strips are parallel to the cathode columns and are separated from one another by an insulator 8, generally silicon oxide ($SiO_2$). Phosphor elements 7 are deposited on electrodes 9, formed of corresponding strips of a transparent conductive layer such as indium and tin oxide (ITO). The sets of red, green, blue strips are, in this example, alternately biased with respect to cathode 1, so that the electrons extracted from the microtips 2 of a pixel of the cathode/grid are alternately directed towards the phosphor elements 7 facing each of the colors.

Generally, the rows of grid 3 are sequentially biased to a potential on the order of 80 volts, while the strips of phosphor elements (for example, 7*g* in FIG. 1) to be energized are biased under a voltage on the order of 400 volts via the ITO strip on which these phosphor elements are deposited. The ITO strips, supporting the other strips of phosphor elements (for example, 7*r* and 7*b* in FIG. 1), are at a low or zero potential. The columns of cathode 1 are brought to respective potentials included between a maximum emission potential and a no emission potential (for example, respectively, 0 and 30 volts). The brightness of a color component of each of the pixels in a line is thus determined.

The choice of the values of the biasing potentials is linked to the characteristics of phosphor elements 7 and of microtips 2. Conventionally, below a potential difference of 50 volts between the cathode and the grid, there is no electron emission, and the maximum emission used corresponds to a potential difference of 80 volts.

A disadvantage of conventional screens is that they suffer from a low lifetime, that is, after a relatively short operating time (on the order of one hundred hours), the screen brightness considerably decreases and destructive phenomena due to the formation of arcs between the screen cathode and anode even sometimes occur.

Further, after a certain operating time, the color appears to vary and no longer corresponds to the screen control orders. This phenomenon will be referred to herein as the "color drift". In practice, this means that one at least of the strips of phosphor material adjacent to the biased strips starts exhibiting a luminescence.

A first known technique to avoid this phenomenon of parasitic luminescence consists of separating, by short time intervals, the biasings of the anode strips between two successive color sub-frames, and applying a negative voltage pulse on the strip just biased before positively biasing the following anode strip to be energized.

However, this technique has the disadvantage of complicating the circuits providing the anode supply voltages, which are voltages of high values (some hundred volts), and of being prejudicial to the screen brightness.

A second known technique consists of depositing, on the insulating strips separating the phosphor strips, a conductive layer biased to a negative or null potential. Such a technique is described, for example, in patent EP-A-0635865. The function of the conductive layer then is to prevent the emission of secondary electrons by the $SiO_2$ insulating layer, and to create a positive charge area between two strips of phosphor elements.

However, a disadvantage of this technique is that, in order not to bear prejudice to the insulation between anode strips, the insulating strips have to be thick (on the order of 50 $\mu$m) so that the deposited phosphor elements (over a thickness on the order of 10 $\mu$m) between these strips are buried with respect to the conductive layer. Another disadvantage is that the implementation of this technique lengthens the duration of manufacturing. Indeed, to be accurate, the etching of the $SiO_2$ layer must be performed by plasma, which is particularly long for such a thickness.

Another disadvantage is that the thickness of the insulating strips must be chosen according to the resistivity of the phosphor elements while this resistivity can be different from one color to another.

Further, the phosphor elements are generally deposited by serigraphy. Now, the alignment of the serigraphy mask with the etching pattern is, in practice, imperfect, so that phosphor elements often extend slightly beyond the holes of the $SiO_2$ layer. In such a case, the insulation is no longer respected, since these over-extensions are performed over the conductive layer.

SUMMARY OF THE INVENTION

The present invention aims at providing a novel solution to the above-mentioned problems of screen lifetime and color drift, which overcomes the disadvantages of known solutions.

The present invention aims in particular at providing a new solution to the problem of parasitic luminescence associated with the switching of the anode strips.

The present invention also aims at providing a solution which is compatible with conventional methods of screen manufacturing and which does not require any additional step in the anode manufacturing method.

To achieve these objects, the present invention provides an anode of a flat display screen of the type including at least two sets of parallel alternate strips of anode conductors coated with phosphor elements, separated from one another by insulating strips and likely to be biased to different potentials according to the phosphor elements to be energized, including focusing conductive strips, aligned and substantially centered with the insulating strips, the focusing conductive strips having lower widths than the insulating strips.

According to an embodiment of the present invention, the focusing strips are biased to a negative or zero potential.

According to an embodiment of the present invention, the thickness of the insulating strips is included between 1 and 5 $\mu$m.

According to an embodiment of the present invention, the focusing strips are deposited on the insulating strips.

According to an embodiment of the present invention, the width of the focusing conductive layers represents between 20 and 60% of the width of the insulating strips.

According to an embodiment of the present invention, the focusing strips are buried in the insulating strips.

According to an embodiment of the present invention, the spacing between a focusing strip and a neighboring anode conductor strip is chosen to withstand a determined potential difference between the two neighboring strips, the width of the conductive strips representing, preferably, from 20 to 90% of the spacing between two neighboring anode conductor strips.

According to an embodiment of the present invention, the focusing strips are formed of the same material as the anode conducting strips.

The present invention also relates to a method of implementation of a flat display screen anode in which the definition mask of the anode conductor strips also defines the pattern of the focusing conductor strips.

The present invention also relates to a flat display screen including a cathode with microtips and an anode formed of at least two sets of alternate strips of phosphor elements and provided with focusing strips.

The foregoing objects, features and advantages of the present invention, will be discussed in detail in the following non-limiting description of specific embodiments made in connection with the accompanying drawings.

DETAILED DESCRIPTION

The same elements have been referred to with the same reference numbers in the different drawings. For clarity, the drawings are not to scale and only those elements which are necessary to the understanding of the present invention have been shown and will be described hereafter.

Figure 1:
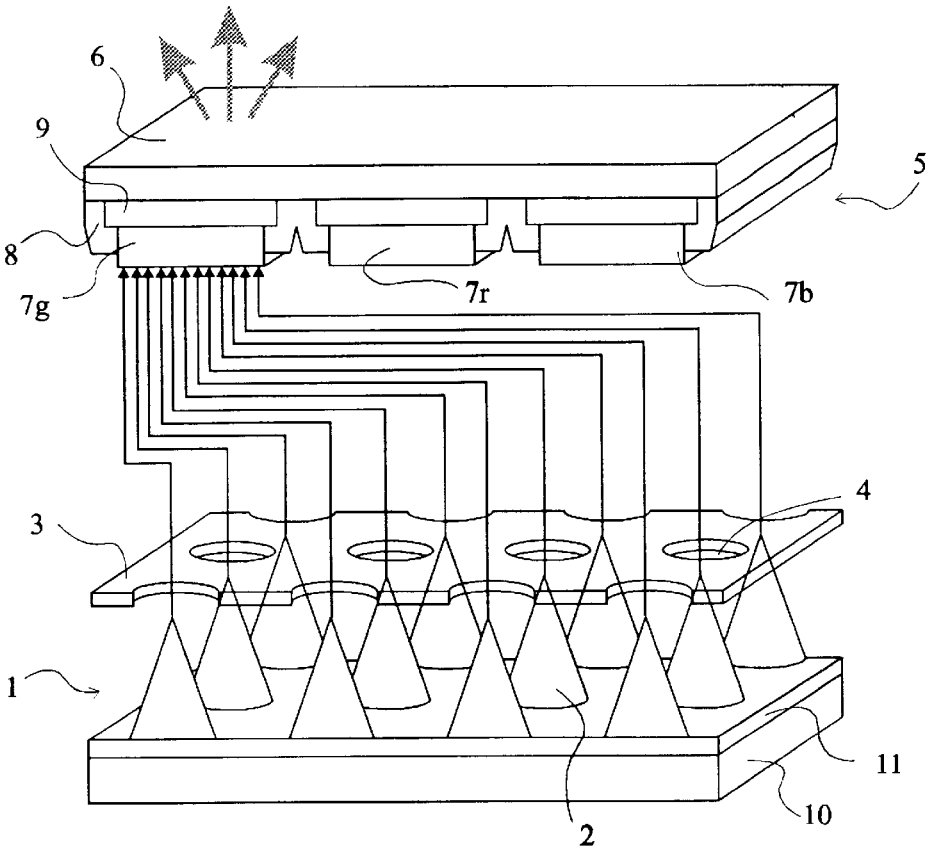
FIG. 1, previously described, is meant to show the state of the art and the problem to solve.
Figure 2:
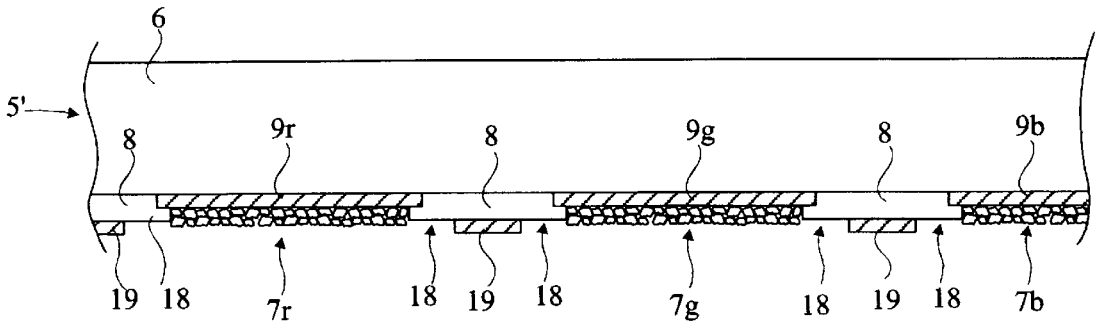
FIG. 2 partially shows, in cross-sectional view, a flat display screen anode according to a first embodiment of the present invention.

FIG. 2 partially shows, in cross-sectional view, an anode according to a first embodiment of the present invention.

As previously, anode 5' is made on a substrate 6, for example, made of glass, and is provided with alternate strips of phosphor elements 7*r*, 7*g*, 7*b*, each corresponding to a color (Red, Green, Blue). The strips are separated from one another by an insulator 8, generally silicon oxide ($SiO_2$). Phosphor elements 7 are deposited on electrodes 9*r*, 9*g*, 9*b*, formed of corresponding strips of a transparent conductive layer such as indium and tin oxide (ITO).

According to this first embodiment of the present invention, additional conductive strips 19 are deposited on the insulating strips 8 separating two neighboring strips of phosphor elements. According to the present invention, the width of additional strips 19 is lower than the spacing separating two neighboring strips of phosphor elements and thus does not entirely cover insulating strips 8. Strips 19 are substantially centered on insulating strips 8 and their width represents, for example, 20 to 60% of the width of strips 8.

According to the present invention, strips 19 are biased to a potential at most equal to the minimum biasing potential of the cathode to create an electric field driving back the electrons emitted by the microtips (not shown). Strips 19 then have a focusing effect on the electrons emitted by the cathode towards strips 9 supporting the phosphor elements. Thus, the proportion of electrons likely to bombard the insulating layer 8 remaining between strips 19 and phosphor elements 7 and, accordingly, the accumulation of negative charges at the surface of this layer 8 is minimized. Further, even if a few electrons succeed in reaching the accessible portions 18 of layer 8 on either side of strips 19, the energy of these electrons is extremely low (close to 0 electron-volt) and these electrons are then incapable of causing the emission of secondary electrons.

An advantage of this embodiment is that the portions 18 of insulator remaining on either side of each strip 19 ensure the insulation between these additional conductive layers and the strips of phosphor elements without it being necessary to increase the thickness of insulating strips 8. Thus, according to the present invention, insulating strips 8 have a thickness which conforms to conventional methods of implementation of a flat screen anode, for example, included between 1 and 5 $\mu$m.

Another advantage with respect to the known technique of patent EP-A-0635865 is that alignment defects between the mask of serigraphy deposition of the phosphor elements with respect to the etching pattern of layer 8 are not disturbing. Indeed, the possible over-extensions of the phosphor elements are here deposited on insulating portions 18. The thickness of the strips of phosphor elements generally is on the order of 10 $\mu$m.

Figure 3:
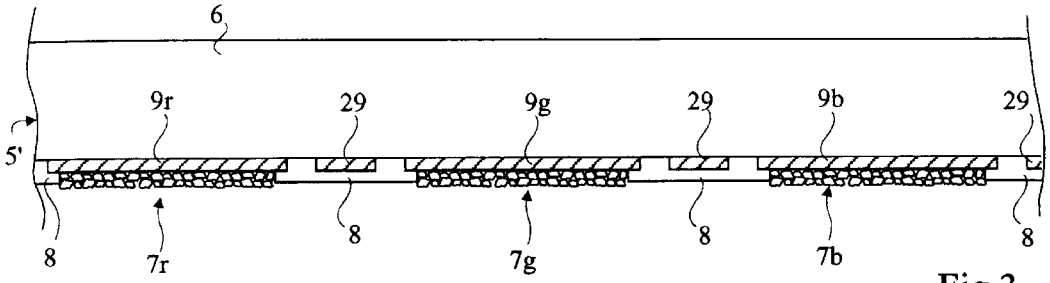
FIG. 3 partially shows, in cross-sectional view, a flat display screen anode according to a second embodiment of the present invention.
Figure 4:
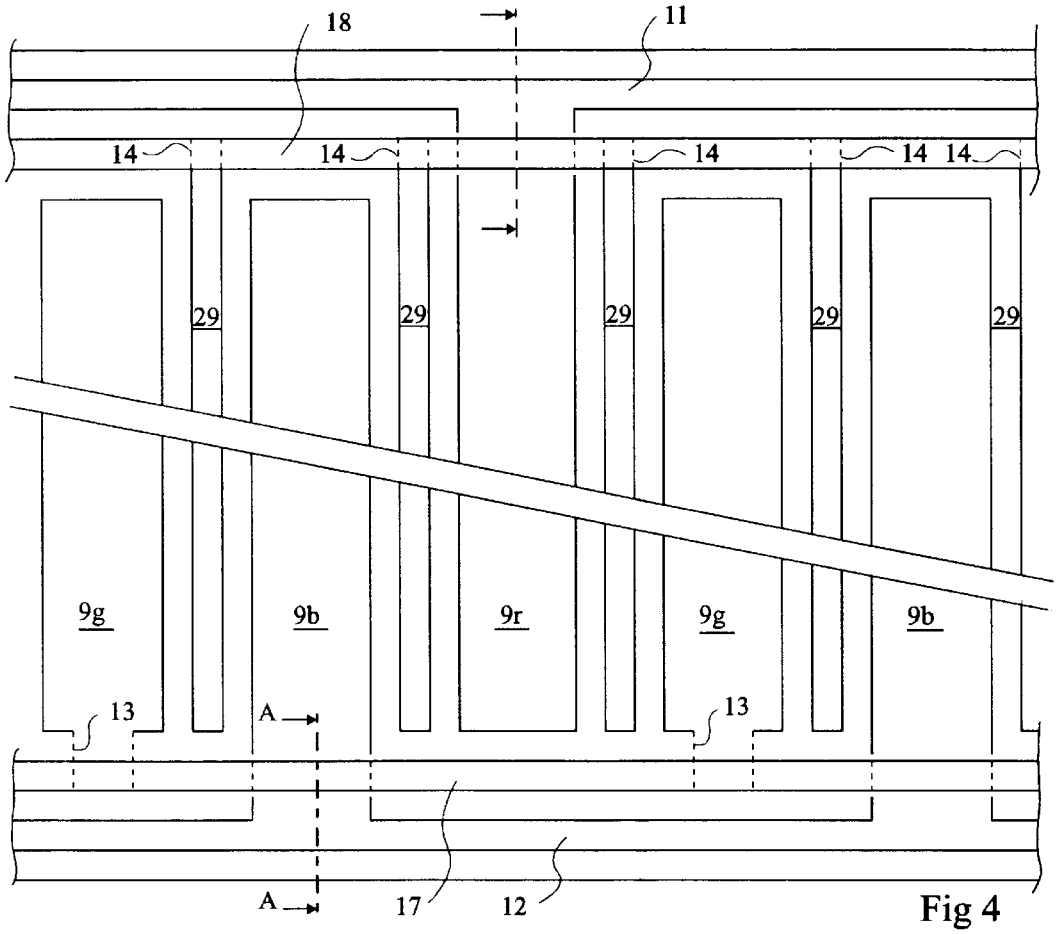
FIG. 4 shows, in bottom view, a flat screen anode such as shown in FIG. 3.

FIGS. 3 and 4 show, respectively in cross-sectional view and in top view, a second embodiment of a flat color display screen according to the present invention. In FIG. 4, all phosphor elements have not been shown.

A characteristic of this embodiment is to provide, between two neighboring conductive layers 9 supporting phosphor elements, an additional conductive layer 29, coated with insulating layer 8 separating strips 9 from one another.

As for the first embodiment, these strips 29 are biased to a potential at most equal to the minimum biasing potential of the cathode, to create an electric field driving back the electrons emitted by the microtips.

Strips 29 are substantially centered between two neighboring strips 9 and have, preferably, a width included between 20 and 90% of the spacing between neighboring strips. Focusing strips 29 may be wider than in the first embodiment. The spacing between a strip 29 and a strip 9 is indeed only linked to the need for insulation between the strips and does not require to guarantee the insulation in case of an over-extension of the phosphor elements. The wider the focusing strips, the more significant the focusing effect for a given potential.

As a specific example of implementation, the width of anode conductor strips 9 is on the order of 80 $\mu$m and the spacing between two neighboring strips of anode conductors is on the order of 40 $\mu$m.

Preferably, strips 29 are formed of the same material (for example, ITO) as strips 9 supporting the phosphor elements. An advantage of such an embodiment is that the implementation of an anode according to the present invention then requires no additional step with respect to a conventional method of manufacturing of a flat screen anode.

Indeed, since focusing conductive strips 29 are buried in insulating layer 8, it is enough to modify the definition mask of anode conductor strips 9 to concurrently form focusing strips 29.

Similarly, the interconnection of strips 29 to enable their biasing can then be performed at the same time as the interconnections of strips 9 are made by sets of strips of same color.

A manufacturing method such as described in patent FR-A-2735254, the content of which is incorporated herein by reference can for example be used.

By using this method, which consists of performing the interconnection of two sets of conductive strips of the anode, on a first level, then the interconnection of the third set on a second level, the interconnection of strips 29 is performed on the second level.

Figure 5A:
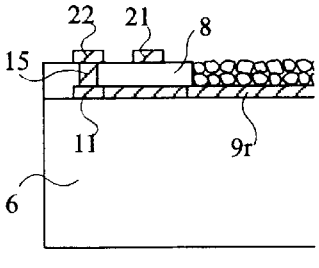
FIGS. 5A and 5B are partial cross-sectional views, respectively, along lines A—A and B—B of FIG. 4.
Figure 5B:
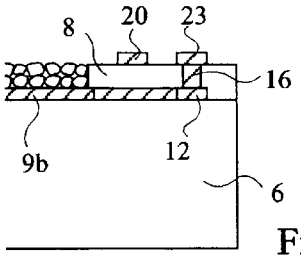

FIGS. 5A and 5B illustrate, by cross-sectional views, respectively taken along lines A—A and B—B of FIG. 4, the interconnections of strips 9 and 29 at their ends.

Two tracks 11 and 12 of interconnection of strips 9*r* and 9*b*, a first series of pads 13 (FIG. 4) at first ends of strips 9*g*, and a second series of pads 14 at second ends of strips 29, are made at the same time as strips 9 and 29.

Then, insulation layer 8 is deposited and etched according to the deposition pattern in strips 7 of the phosphor elements above strips 9 in the active area of the screen, as well as according to the pattern of pads 13 and 14. Layer 8 is also opened to create two pads 15 and 16 (FIGS. 5A and 5B) of connection of tracks 11 and 12.

The openings made above pads 13, 14 and 15, 16 are filled with a conductive material to transfer the contacts above layer 8.

A conductive layer is then deposited and etched according to the pattern of two tracks 20 and 21 of interconnection of pads 13 and of pads 14, and according to the pattern of pads 15 and 16 to create pads 21 and 22 of connection of tracks 11 and 12.

An advantage of the present invention is that the provided structure is perfectly compatible with the steps of a conventional method of manufacturing of a flat screen anode.

For a flat color microtip screen, the grid of which is biased to a potential of approximately 80 volts and the microtips of which are biased between 0 volt (maximum emission) and 30 volts (no emission), strips 19 or 29 are, for example, biased to a potential included between 0 and −200 volts.

The more the biasing potential of the focusing strips is lower than the minimum biasing potential of the cathode, the more the focusing effect is significant. Thus, by choosing a sufficiently negative potential, it is acknowledged that all electrons are driven back from the interval separating two strips of phosphor elements.

An advantage of the present invention is that it suppresses the color drift phenomenon observed on conventional screens.

Another advantage of the present invention is that it considerably improves the lifetime of the screen by suppressing any risk of creation of an arc between two bands of phosphor elements.

It should be noted that the present invention also applies to a monochrome screen in which the phosphor elements of the anode are supported by anode electrodes organized in two sets of alternate strips of phosphor elements of same color. In this case, the present invention still improves the screen resolution which is already better than that of a screen, the anode of which is formed of a plane of phosphor elements of same color.

Of course, the present invention is likely to have various alterations, modifications, and improvements which will readily occur to those skilled in the art. In particular, the biasing potential of the focusing strips and their width can be modified according to the type of screen and to the biasing potentials of its components.

Such alterations, modifications, and improvements are intended to be part of this disclosure, and are intended to be within the spirit and the scope of the invention. Accordingly, the foregoing description is by way of example only and is not intended to be limiting. The invention is limited only as defined in the following claims and the equivalent thereto.

What is claimed is:

1. An anode for a flat display screen comprising:

at least two sets of parallel alternate strips of anode conductors coated with phosphor elements, separated from one another by insulating strips, said at least two sets of parallel alternate strips of anode conductors biased to different potentials according to the phosphor elements to be energized; and focusing conductive strips, aligned and substantially centered with the insulating strips, the focusing conductive strips having lower widths than the insulating strips.

2. The anode of claim 1, wherein the focusing strips are biased to a negative or zero potential.

3. The anode of claim 1, wherein the thickness of the insulating strips is included between 1 and 5 $\mu$m.

4. The anode of claim 1, wherein the focusing strips are deposited on the insulating strips.

5. The anode of claim 4, wherein the width of the focusing conductive strips represents between 20 and 60% of the width of the insulating strips.

6. The anode of claim 1, wherein the focusing strips are buried in the insulating strips.

7. The anode of claim 6, wherein the spacing between a focusing strip and a neighboring anode conductor strip is chosen to withstand a determined potential difference between the two neighboring strips, the width of the conductive strips representing, preferably, from 20 to 90% of the spacing between two neighboring anode conductor strips.

8. The anode of claim 6, wherein the focusing strips are formed of the same material as the anode conducting strips.

9. A method of manufacturing the flat display screen anode of claim 8, wherein the definition mask of the anode conductor strips also defines the pattern of the focusing conductor strips.

10. A flat display screen comprising:

a cathode with microtips;

an anode formed of at least two sets of parallel alternate strips of anode conductors coated with phosphor elements, separated from one another by insulating strips, said at least two sets of parallel alternate strips of anode conductors biased to different potentials according to the phosphor elements to be energized; and focusing conductive strips, aligned and substantially centered with said insulating strips, said focusing conductive strips having lower widths than said insulating strips.

11. The flat display screen of claim 10, wherein the focusing strips are biased to a potential lower than or equal to the minimum biasing potential associated with the cathode.

* * * * *